United States Patent [19]

Goodman

[11] Patent Number: 4,702,920

[45] Date of Patent: Oct. 27, 1987

[54] POTTER'S WHEEL WITH ROTATING EXTRUDER

[76] Inventor: William Goodman, 213 E. 43rd St., Hibbing, Minn. 55746

[21] Appl. No.: 931,525

[22] Filed: Nov. 17, 1986

[51] Int. Cl.[4] ..... B28B 1/02

[52] U.S. Cl. ..... 425/459; 425/266; 425/381; 425/425

[58] Field of Search ..... 264/310, 323; 408/128; D15/130, 135, 136; 425/87, 256, 263-268, 296, 318, 319, 376 R, 376 B, 381, 381.2, 382 N, 392, 402, 425, 435, 459, 324.1, DIG. 120

[56] References Cited

U.S. PATENT DOCUMENTS

| | | | |
|---|---|---|---|
| 828,083 | 8/1906 | Beswick | D15/130 |
| 1,055,463 | 3/1913 | Van Huffel | 425/381 |
| 2,634,692 | 4/1953 | Sherbondy | 425/376 R |
| 3,751,206 | 8/1973 | Bradshaw et al. | 425/264 |
| 3,894,830 | 7/1975 | Edwards | 425/459 |
| 3,947,174 | 3/1976 | Hureau et al. | 425/380 |
| 3,995,983 | 12/1976 | Shenker | 425/263 |
| 4,125,349 | 11/1978 | Johnsen | 425/380 |
| 4,260,354 | 4/1981 | Gilman et al. | 425/DIG. 120 |
| 4,286,938 | 9/1981 | Ryckman | 425/266 |
| 4,332,543 | 6/1982 | Matsui | 425/459 |

FOREIGN PATENT DOCUMENTS

| | | | |
|---|---|---|---|
| 785081 | 10/1957 | United Kingdom | 425/263 |
| 1223108 | 2/1971 | United Kingdom | 425/459 |

*Primary Examiner*—Jay H. Woo
*Assistant Examiner*—J. Fortenberry
*Attorney, Agent, or Firm*—Douglas L. Tschida

[57] ABSTRACT

A potter's table including a rotating pneumatic clay extruder coupled to the potter's wheel. Clay is fed from a vented storage cylinder in centered relation to the wheel past an interchangeable template via a hand valve controlled pneumatic piston and rotatable ram head coaxially mounted within the storage cylinder. An electric foot-operated, proportional speed belt drive, belt tensioning assembly and upper and lower bearing assemblies support the cylinder and potter's wheel in rotative relation to the table and pneumatic piston.

20 Claims, 4 Drawing Figures

POTTER'S WHEEL WITH ROTATING EXTRUDER

BACKGROUND OF THE INVENTION

The present invention relates to potter's wheels and, in particular, to a table-mounted wheel having an integral rotatively mounted extruder mechanism.

The principal tool of any potter is the potter's wheel and the design of which has, over time, remained substantially unchanged. Generally, it comprises a flat wheel which is rotatively mounted to a fixed table and whereon a ball of working clay is positioned (i.e. centered) for access by the potter. The speed of rotation of the wheel is varied as the potter shapes the clay into a desired form. For example, bowls, vases, pitchers and the like are progressively formed by kneading and pinching the clay into a cylindrical shape as the wheel turns. Depending upon the height of the piece and the desirability of obtaining a matched set, it is a time consuming process which depends greatly on the skill of the potter.

Independently mounted extruders have also been developed for making various cylindrical pottery pieces. They are generally comprised of a storage cylinder having an appropriately sized extrusion template mounted to one end and interiorly of which the clay is placed above a ram head that, in turn, is mounted to the piston of a pneumatic or hydraulic cylinder. As the piston is extended, the clay is forced past the template and a rough cylinder of a desired diameter and wall thickness is formed. Once the piece is completed, a separately rolled bottom is attached with slip (i.e. liquid clay). Alternatively, the piece is placed on a flat plaster of Paris surface, filled to a desired height with slip and allowed to set to form the bottom for the piece. The principal advantage, though, of an extruder being the ability to repeatedly make uniform walled pieces.

Recognizing that conventional potter's wheels don't inherently provide the uniformity achievable with an extruder, the present invention contemplates a single piece of equipment including the advantages of both, as well as others. Such an assembly not only reduces the number of pieces of required equipment, but also provides additional advantages in making available a supply of clay in immediate proximity to the table. Ideally, the clay is available at the center of the wheel to save the potter's time in adjusting the clay position to find the center. Depending on the type of extrusion template, measured amounts of clay are thus controllably dispensable by volume and weight and even form, at predetermined, uniform thicknesses, with the potter thereby being able to more efficiently produce individual and matched sets of pieces.

SUMMARY OF THE INVENTION

It is accordingly a primary object of the invention to provide a potter's wheel having an integral rotatively mounted extruder.

It is a further object to mount the storage cylinder at the center of the potter's wheel relative to a mounting site for interchangeable templates, such that clay may be dispensed in one of a variety of forms as it is turned by the potter.

It is another object of the invention to provide an adjustable bearing support for the storage cylinder which allows it to be centered in relation to the table and an extrusion cylinder and thereby obtain vibration-free rotation.

It is still another object of the invention to provide a readily accessible pneumatic or hydraulic extrusion control in cooperative relation to the drive control to the potter's wheel.

It is a still further object to provide a means for maintaining constant drive belt tension.

These and other objects and advantages of the invention are achieved in the present construction and wherein a storage cylinder is mounted in rotative relation to a potter's table beneath the potter's wheel. A lower lying pneumatic cylinder, having a piston coupled to a rotative ram head internal to the cylinder, controls the extrusion of clay relative to an interchangeable template coaxially mounted within the wheel.

A first bearing assembly mounted to the table above the pneumatic cylinder supports the lower end of the storage cylinder. A pair of rubber wheels, laterally adjustably mounted to the table top in a yoke member, in turn, support the upper end of the cylinder in proper relation to the table and the pneumatic cylinder.

Wheel speed is controlled via a foot-actuated proportional speed, motor control. The extension of the pneumatic piston and ram head in the storage cylinder is controlled via a dual action hand valve. The ram head and storage cylinder thus rotate, along with the wheel, to force clay past the template as the ram is controllably extended. Clay passing between the ram head and interior cylinder walls escapes via one or more vent holes at the cylinder bottom.

The above objects, advantages and distinctions of the present invention, among others, along with its detailed construction, will become more apparent upon reference to the following description thereof with respect to the appended drawings. Before referring to the description though, it is to be appreciated that it is made by way of the presently preferred embodiment only and thus is not intended to be inclusive of all those various alternative embodiments which might suggest themselves to those of skill in the art. To the extent though that alternative embodiments or modifications may have been considered, mention will be made as appropriate.

DESCRIPTION OF THE PREFERRED EMBODIMENT

Figure 1:
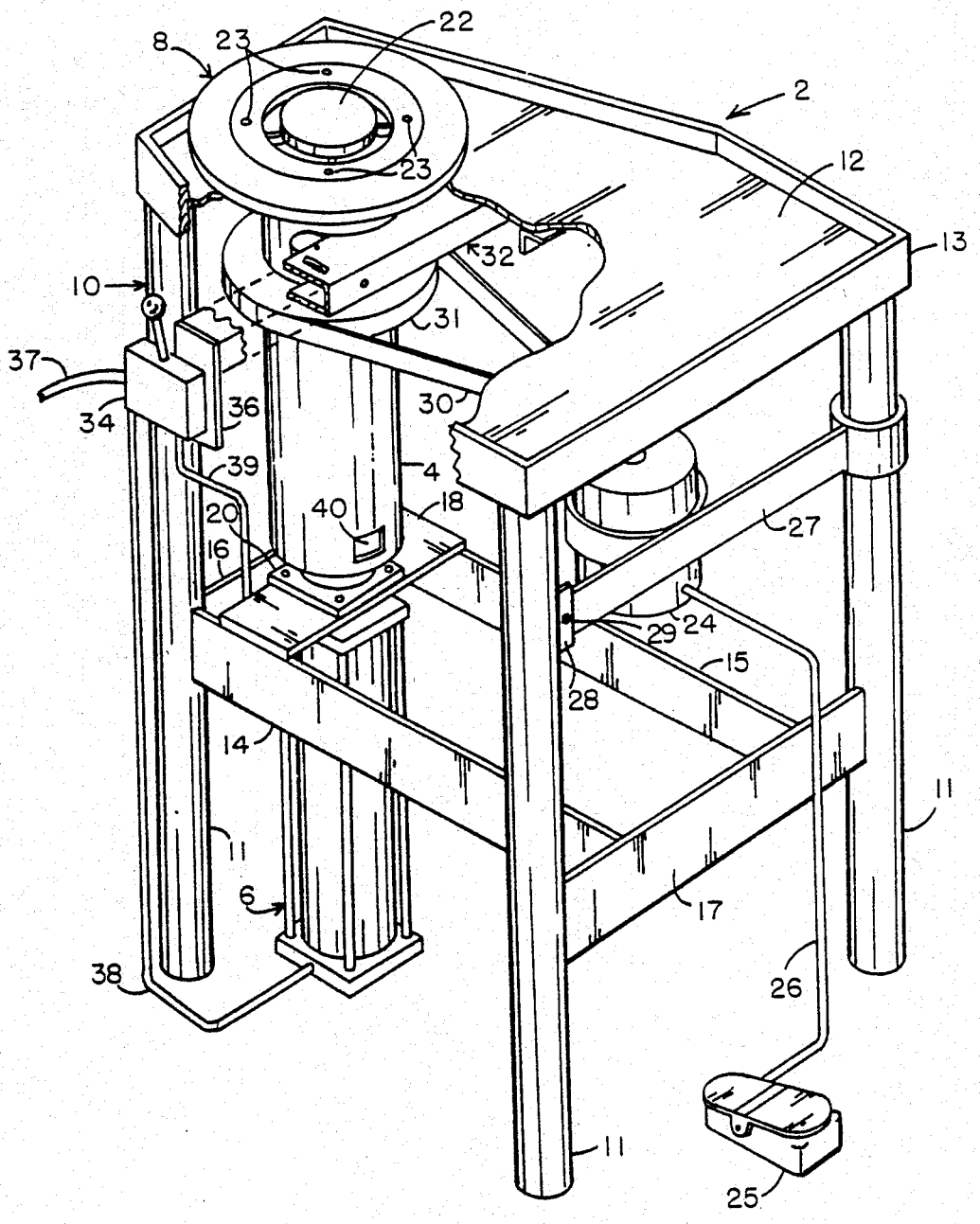
FIG. 1 shows a front elevation view in partial cutaway of the present potter's wheel with rotating extruder.

Referring to FIG. 1, a front elevation view is shown of the present invention and which comprises an improved potter's table 2 that has been modified to include a rotating, clay containing extrusion or storage cylinder 4 and pneumatic or hydraulic ram 6. In lieu of separate forming and extrusion equipment, the invention combines these functions into a single piece of equipment and whereby a wide range of pieces may be produced with improved efficiencies.

That is, upon filling the extrusion cylinder 4, a potter may now controllably extrude either a working ball of clay at the center of the wheel or, alternatively, a finished cylinder or any number of other tubular constructions of uniform wall thickness and height, and all without leaving the wheel 8. In conventional fashion, the extruded clay may then in either case be further formed or cut away from the wheel 8 and allowed to cure and/or have handles attached, etc.

With particular attention directed to FIG. 1, the presently improved potter's table 2 is constructed about a relatively sturdy metal table 10 having four tubular support legs 11 which support the table top 12 approximately thirty-six to forty inches off the floor surface. The table top 12 is generally of a rectangular shape and is sized to be approximately twenty-one inches wide by twenty-seven inches long, although the end containing the wheel 8 is tapered slightly to facilitate access thereto. A vertical lip 13 is formed about the peripheral edges of the table top 12 to prevent tools etc. from vibrating off and to contain the excess water which is periodically used during the shaping of each piece.

Mounted beneath the table top 12 between right and left lateral leg braces 14 and 15 which, in turn, are secured to a pair of opposed cross leg brace members 16 and 17, is the pneumatic ram 6. The ram 6 is secured via screws (not shown) to the bottom of a bearing support plate 18 suspended across the tops of the lateral braces 14 and 15 such that the bottom of the ram 6 is suspended slightly above the floor surface. A lower cylinder bearing assembly 20 is mounted to the top of the plate 18 and supports the lower end of the extrusion cylinder 4. Coaxially positioned within the extrusion cylinder 4 and passing through the plate 18 and bearing 20 is the piston (not shown) of the pneumatic ram 6 and a ram head (also not shown), but both of which will be described in greater detail hereinafter. Mounted lastly to the upper end of the extrusion cylinder 4 is the disk-like potter's wheel 8 and coaxially interiorly of which is secured an extrusion template 22 via screw fasteners 23. The template 22 mounts flush with the wheel surface.

Also mounted beneath the table 2 and to the right side is a proportional speed, electric motor 24, the speed of which is electronically controlled by way of a foot pedal 25 and cable 26. The motor 24 is mounted to the table 2 under spring tension to a cross plate 27 that is hinged at its one end to the far leg and spring-biased toward the near leg via a spring bracket member 28, bolt 29 and spring (not shown) mounted between the end of the bolt 29 and the back of the plate 27. The motor 24 supplies rotational drive to the extrusion cylinder 4 by way of V-belt 30 and mating V-pulley 31, coaxially mounted about the cylinder 4.

An upper cylinder bearing assembly 32 mounted to the bottom of the table top 12 supports the cylinder 4 in coaxial relation to a hole (not shown) formed therein and is adjustable to allow the positioning of the cylinder's axis of rotation so that the rotation is as vibration and wobble-free as possible, and to center the ram piston within the cylinder 4. A dual action, pneumatic hand valve 34 mounts to a side plate 36 at one end of the upper bearing assembly 32 and to one side and beneath the table top 12 and controls the extension of the ram's piston by appropriately directing air from supply line 37 relative to input and return lines 38 and 39. A vent hole 40 formed in the bottom wall of the cylinder 4 evacuates any residual clay which leaks past the ram head. In passing, it is to be appreciated that even though a pneumatic cylinder 4 is used in the presently preferred embodiment, alternatively a hydraulic cylinder could be used.

Operationally therefore, the potter's table 2 merely requires a source of compressed air for operating the pneumatic ram 6; a source of electricity for operating the motor 24; and a sufficient supply of clay for filling the storage cylinder 4. No additional floor space is required for a separate extruder and a potter's efficiency is increased, since he/she need now stop working only to fill the cylinder 4 and/or change the template 22; otherwise, the clay is always dispensed at the center of the cylinder and may be extruded to any desired shape, depending upon the type of template 22. It is to be further appreciated that the cylinder 4 may be used to store clay for short durations by merely covering the template 22, without fear of drying.

Figure 2:
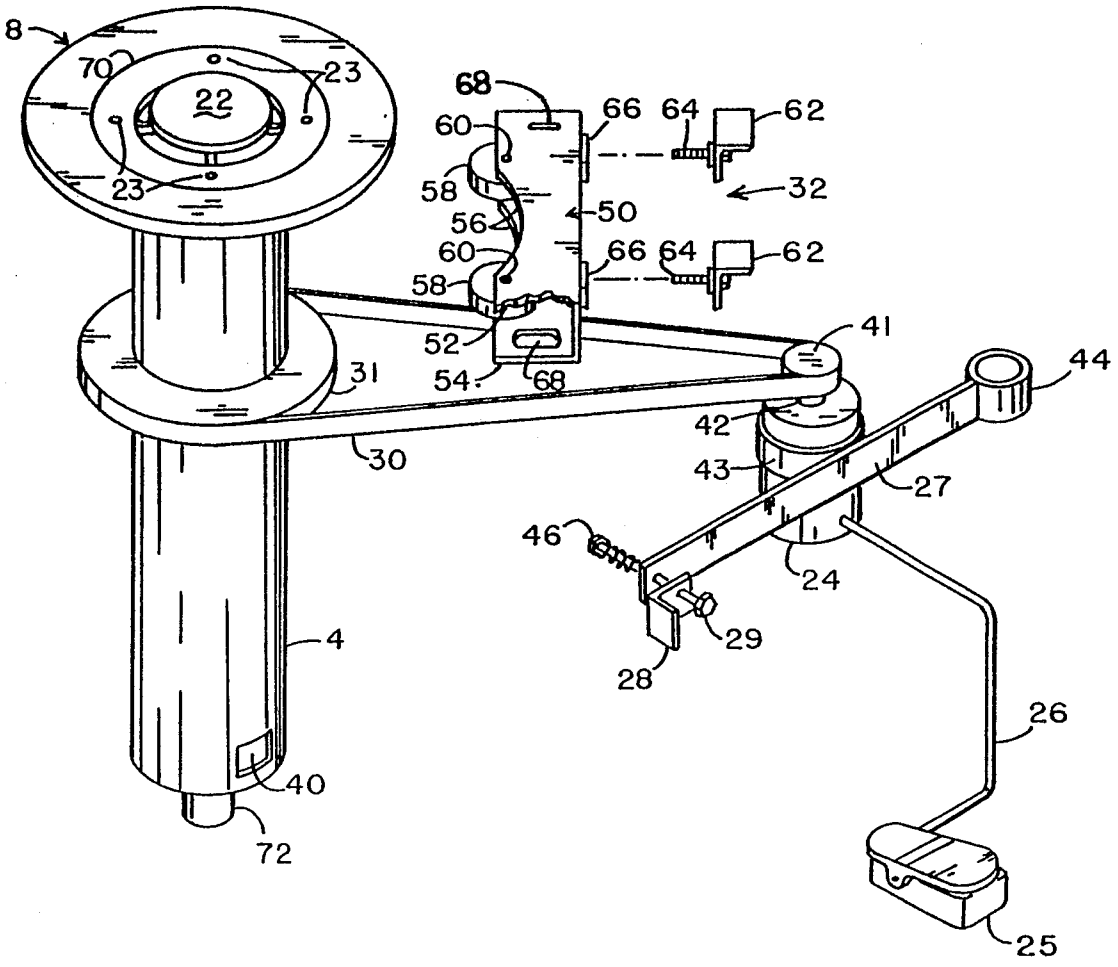
FIG. 2 shows an exploded assembly view in partial cutaway of the motor drive to the storage cylinder.

Turning attention next to FIG. 2, a detailed exploded assembly view is shown in perspective of the cylinder drive assembly. As mentioned, rotational drive power is supplied via DC motor 24 and the speed of which is controlled by foot pedal 25. In the presently preferred embodiment, the motor 24 supplies power to the cylinder 4 at a stepped down gear ratio of 10:1 through the use of a one inch diameter pulley 41 mounted to the motor drive shaft 42 and a ten inch diameter pulley 31 mounted to the cylinder 4. The pulley 31 is secured to the cylinder 4 via a number of set screws (not shown) that mount through the bottom of the pulley's V-channel. The motor 24 is also sized in a range of $\frac{3}{4}$ to $1\frac{1}{2}$ horsepower which has been found sufficient to control the rotation of the mass to be turned (i.e. the cylinder 4, wheel 8 and clay) within a range of zero to three hundred rpm. While a 120 volt DC motor 24 is used, it is to be appreciated that other voltages or else AC motors may alternatively be used, just as a different size motor may be required for larger capacity cylinders.

The tension on the V-belt 30 is adjusted by way of the previously mentioned cross plate 27 and spring bracket 28. As better seen in FIG. 2, the cross plate mounts to the motor 24 via a band clamp 43 coupled therebetween, while a short length of pipe 44 of a diameter slightly greater than the table leg 11 is welded to the far end of plate 27 and pivotally mounted in the fashion of a hinge about the leg 11. The near end of plate 27 is secured in sliding relation to the spring bracket 28 via the through bolt 29, with the bracket 28 being welded to the near leg 11. A spring 45 mounts over the bolt 29, behind the plate 27, and the tension of which assembly is adjusted by turning the nut 46 in or out along the bolt 29. Thus, a constant tension is adjustably maintained on the belt 30 and in a fashion that readily permits belt changes without undue disassembly.

Turning attention to the upper cylinder bearing assembly 32, it is adjustably mounted to the bottom of the table top 12, above the pulley 31. It comprises a yoke collar sub-assembly 50 having upper and lower formed plates 52 and 54 and between which and in overlapping tangential relation to a curved cutout region 56 of which are positioned a pair of rubber rollers or wheels 58. Individual axles 60 extend through the plates 52 and 54 secure the rollers 58 thereto. The exterior side walls of the cylinder 4 thus extend into the yoke 50 in the region of the curvature 56 and are supported by the rollers 58. Not shown is the mounting of the hand valve 34 to the yoke 50, but which it is to be recalled is secured thereto via a welded end plate 36, as mentioned in FIG. 1.

The yoke assembly 50 is adjustably secured to the bottom of the table top 12 by way of a pair of L-shaped standoffs 62 welded thereto. Bolt fasteners 64 extend through and rotate within the standoffs 62 and mate with a pair of threaded tabs 66 mounted to the backs of the plates 52 and 54. Cutout openings or slots 68 at the ends of the top and bottom plates 52 and 54 provide access to bolt fasteners (not shown) welded to the table top 12 that extend downward through the upper slots 68 and mate with lock nuts (not shown) which pinch the top plate 52 against the table top 12. The yoke 50 may thus be adjustably positioned along the bolts 64 to center the cylinder 4 relative to the table, the lower bearing 20 and the pneumatic ram 6. Between the adjustment of the belt tensioning assembly and the yoke 50, the cylinder 4 may be adjusted to rotate in a vibration and wobble-free relation to the table top 12.

Weldably secured to the upper end of the cylinder 4 is the working surface of the potter's wheel 8 and which in the presently preferred embodiment is approximately fourteen inches in diameter. An extrusion template receiving ridged opening 70 is provided at the center of the wheel 8 and whereat, when the template 22 is removed, the cylinder 4 is filled with clay. Depending upon the pieces to be made, extrusion templates 22 of different center shapes and cutout diameters are secured over the opening 70 to the underlying ledge with the screw fasteners 23. The details thereof however can better be seen with respect to FIG. 3.

Turning attention to the lower end of the cylinder 4, a rectangular opening 40 or vent is provided for evacuating residual clay which may leak between the ram head and the interior cylinder walls. As it collects at the interior bottom of the storage cylinder 4, it may be scraped from the cylinder 4 or, alternatively, over time, additional build-up and centrifugal force will push the residue out the opening 40. In lieu of a single opening 40, it is also to be appreciated that other openings may be provided as needed. Coaxially extending from the bottom end of the cylinder 4 is a two inch diameter end collar 72 which rests within the lower cylinder bearing 20 as the cylinder 4 rotates.

Figure 3:
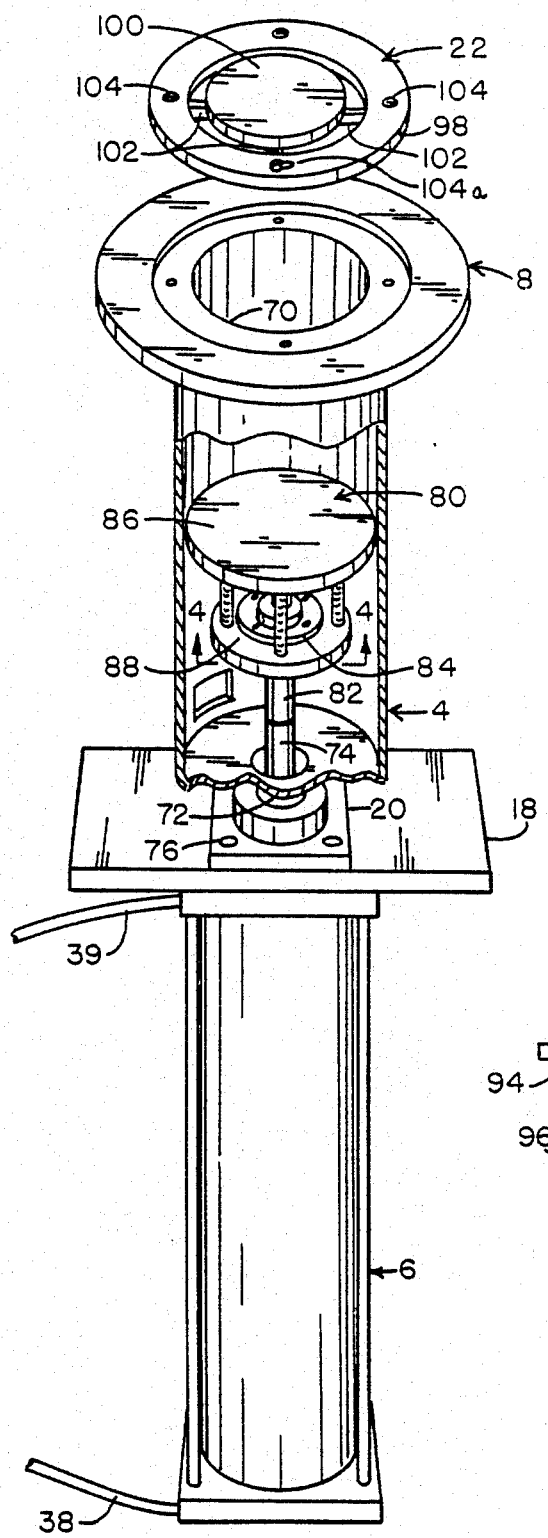
FIG. 3 shows an exploded assembly view in partial cutaway of the storage cylinder and internal pneumatic piston and ram head assembly.

In this latter regard and turning attention next to FIG. 3, a detailed perspective view is shown in partial cutaway through the interior of the storage cylinder 4 and wherefrom the mounting relation of the cylinder 4 to the pneumatic ram 6 and ram head 80 can better be seen. Also shown is a typical cylindrical extrusion template 22.

As mentioned, the cylinder 4 is suspended from the bottom of the bearing support plate 18 with the lower bearing assembly 20 mounted in overlying coaxial relation thereto. The end collar 72 of the cylinder 4 mounts within the bearing 20 and the ram piston 74 is positioned to extend through a 1½ inch diameter hole through the plate 18 and past the collar 72 in coaxial non-contacting relation to the cylinder walls. The storage cylinder 4 is thus free to rotate independently of the piston 74, which, in turn, may be extended or retracted as necessary to expel clay from or allow the cylinder 4 to be filled.

Threadably secured to the upper end of the piston 74 is a ram head 80. The upper end of the piston 74 includes threads for mating with a threaded stub shaft 82 of the ram head 80. The shaft 82, in turn, is mounted between a pair of bearings (the lower bearing 84 of which is shown) attached to upper and lower ram head plates 86 and 88. Thus, the ram head plates 86 and 88 are able to rotate, while the stub shaft 82 remains stationary relative to the ram piston 74.

Figure 4:
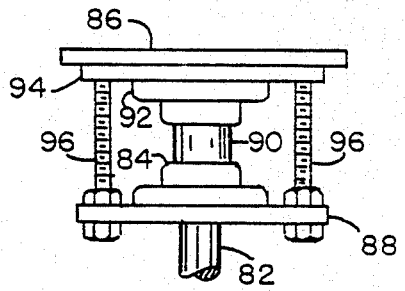
FIG. 4 shows a detailed cross-section view, taken along reference lines 4—4 of FIG. 3, through the ram head.

In particular and directing attention to FIG. 4, a detailed cross-section view taken along reference lines 4—4 of FIG. 3 is shown of the ram head 80. The independent rotation of the ram head plates 86 and 88 is achieved by way of the upper and lower bearings 92 and 84, the inner bearing portions of which are mounted in compressive cam locked relation to the end portion 90 of stub shaft 82. The outer portion of upper bearing 92, in turn, is mounted to an intermediate plate 94, attached beneath the upper ram head plate 86, and from which a number of plate alignment bolts 96 extend downward. By adjusting the separation between the plates 88 and 94 via the bolts 96, the plates are brought into parallel alignment with one another so that the ram head 80 rides smoothly in the bearings 84 and 92 and in coaxial concentric relation to the cylinder walls. As the clay in the storage cylinder 4 is rotated, the ram head 80 is thus able to rotate within the cylinder 4, although the speeds of relative rotation may be different depending upon the frictional engagement of the clay with the interior cylinder walls.

Returning attention to FIG. 3 and mounted to the upper end of the potter's wheel 8 is a typical extruder template 22 which, for cylindrical pieces, comprises an outer ring portion 98 and an interior circular disk 100 secured thereto via a number of fingers 102 extending from the bottom of the outer ring 98 to the bottom of the center disk 100. Depending upon the desired wall thickness of the extruded clay cylinder, templates 22 having differing sized circular centers 100 may be interchanged with one another. Alternatively, a template having no center disk 100 need be used and in which event a centered ball of clay is fed onto the wheel 8.

As mentioned, the interchanging of templates 22 is achieved by way of the screw fasteners 23 which secure the template 22 to the flanged opening 70. Not shown and mounted to the exposed heads of the screws 23 is a circular ceramic "bat" or disc that mounts to the top of the wheel 8 and on which the clay rests. The "bat" also includes a hole to allow the extruded clay to pass therethrough.

At present, it is to be noted that the screw receiving holes 104 of the template 22 are merely drilled. It is contemplated however that the holes 104 might be shaped more as oblong keyholes in the fashion of the hole 104*a* (drawn for illustrative purposes) to facilitate the interchanging of templates 22 by allowing the twist tightening and loosening of the templates 22 from the screw fasteners 23, which would be more or less permanently mounted to the cylinder 4. A countersunk ridge formed along the sides of each hole may also be tapered such that as the template 22 is turned, it is progressively brought into locked contact with the screw heads.

While the present invention has been described with respect to its presently preferred embodiment and various modifications thereto, it is to be appreciated that still other modifications may be made without departing from the spirit and scope of the invention. It is accordingly contemplated that the following claims should be interpreted so as to include all those equivalent embodiments within the spirit and scope thereof.

What is claimed is:

1. A potter's table comprising:

(a) a multi-legged table having an upper working surface;
(b) a flat disk-like wheel extending above said working surface and rotatably mounted to said table;
(c) means for rotating said wheel at a working speed;
(d) means coupled to said wheel for storing a supply of clay; and
(e) means for extruding clay from said storage means through the upper surface of said wheel for access by a potter.

2. Apparatus as set forth in claim 1 wherein said table includes a rim surrounding the working surface thereof.

3. Apparatus as set forth in claim 1 wherein said wheel includes an interchangeable extrusion template coaxially mounted thereto.

4. Apparatus as set forth in claim 3 wherein said extrusion template includes a plurality of oblong holes whereby the template may be twist connected to mating fasteners secured to said wheel.

5. Apparatus as set forth in claim 4 wherein each hole includes a countersunk ridge of progressively increasing thickness from its widest to narrowest portions.

6. Apparatus as set forth in claim 1 wherein said rotation means comprises:
(a) a motor mounted to said table;
(b) a first pulley mounted to said motor;
(c) a second pulley mounted to said clay storage means; and
(d) a belt coupled under tension between said first and second pulleys.

7. Apparatus as set forth in claim 6 wherein said motor is mounted to a plate hingedly coupled to said table, one end of said plate having a tubular hinge member mounted about a table leg and the other end coupled via a bolt to a bracket secured to another table leg and including a spring adjustably mounted to said bolt for biasing said plate away from said motor.

8. Apparatus as set forth in claim 1 wherein said storage means comprises an elongated hollow cylinder.

9. Apparatus as set forth in claim 8 including:
(a) tubular collar coupled to one end of said storage cylinder;
(b) a lower bearing means for receiving said collar and rotatively supporting one end of said storage cylinder; and
(c) upper bearing means for rotatively supporting the other end of said storage cylinder relative to said table.

10. Apparatus as set forth in claim 9 wherein said upper bearing means comprises:
(a) a curved yoke member;
(b) a plurality of wheels rotatively mounted to said yoke member in contacting engagement with the exterior of said storage cylinder; and
(c) means for adjustably mounting said yoke member to said table whereby the position of said storage cylinder may be varied relative to said extrusion means and said table.

11. Apparatus as set forth in claim 1 wherein said extrusion means includes:
(a) a pneumatic ram mounted to said table in coaxial alignment with the longitudinal axis of said storage means; and
(b) means for controlling the extension of a piston extending from said ram interiorly of said storage means and thereby the amount of clay forced from said storage means.

12. Apparatus as set forth in claim 11 including a ram head rotatively mounted to a distal end of said piston and slidably operable in said storage means.

13. Apparatus as set forth in claim 12 wherein said ram head comprises:
(a) a lower plate member having a first bearing mounted to an upper surface thereof;
(b) an upper ram head plate contacting the clay;
(c) an intermediate plate member coupled beneath said ram head plate and having a second bearing mounted to a lower surface thereof;
(d) an elongated ram head shaft threaded at one end, extending through said lower plate and supported in coaxial relation to said first and second bearings; and
(e) means adjustably securing said lower and intermediate plates relative to one another.

14. Apparatus as set forth in claim 1 wherein said storage means includes at least one vent opening whereat clay residue may be evacuated.

15. A potter's table comprising:
(a) a multi-legged table having an upper working surface;
(b) a flat disk-like wheel extending above said working surface of said table;
(c) an elongated, hollow cylindrical storage chamber coupled to said wheel for containing a supply of clay and including at least one vent hole for evacuating clay residue therefrom;
(d) means for rotating said wheel at a working speed;
(e) bearing means for rotatively supporting said cylinder; and
(f) means for extruding clay from said storage means through the upper surface of said wheel for access by a potter.

16. Apparatus as set forth in claim 15 wherein said bearing means comprises:
(a) a lower bearing means coupled to said table for rotatively receiving a collar secured to the lower end of said storage cylinder; and
(b) an upper bearing means comprising:
(1) a curved yoke member;
(2) a plurality of wheels rotatively mounted to said yoke member in contacting engagement with the exterior of said storage cylinder; and
(3) means for adjustably varying the position of said yoke member relative to said table and to said extrusion means.

17. Apparatus as set forth in claim 16 wherein said rotation means comprises:
(a) a motor mounted to said table;
(b) a first pulley mounted to said motor;
(c) a second pulley mounted to said storage chamber; and
(d) a belt coupled under tension between said first and second pulleys.

18. Apparatus as set forth in claim 17 wherein said motor is mounted to a plate hingedly coupled to said table, one end of said plate having a tubular hinge member mounted about a table leg and the other end coupled via a bolt to a bracket secured to another table leg and including a spring adjustably mounted to said bolt for biasing said plate away from said motor.

19. Apparatus as set forth in claim 17 wherein said extrusion means includes:
(a) a pneumatic ram mounted to said table in coaxial alignment with the longitudinal axis of said storage means;

(b) means for controlling the extension of a piston extending from said ram interiorly of said storage means and thereby the amount of clay forced from said storage means; and (c) a ram head rotatively mounted to a distal end of said piston and of a diameter less than the interior of said storage cylinder.

20. Apparatus as set forth in claim 19 wherein said ram head comprises:

(a) a lower plate member having a first bearing mounted to an upper surface thereof;

(b) an upper ram head plate contacting the clay;

(c) an intermediate plate member coupled beneath said ram head plate and having a second bearing mounted to a lower surface thereof;

(d) an elongated ram head shaft threaded at one end to mate with said piston and supported in rotative concentric relation within said first and second bearings; and (e) means adjustably securing said lower and intermediate plate members in planar parallel relation to one another.

* * * * *